United States Patent [19]

Harris

[11] 4,029,144

[45] June 14, 1977

[54] HEAT EXCHANGER ASSEMBLIES

[75] Inventor: Peter John Harris, Birmingham, England

[73] Assignee: GKN Birwelco Limited, Birmingham, England

[22] Filed: Dec. 6, 1974

[21] Appl. No.: 530,387

[30] Foreign Application Priority Data

Dec. 8, 1973 United Kingdom ..... 57002/73

[52] U.S. Cl. ..... 165/124; 165/DIG. 1; 261/DIG. 11

[51] Int. Cl.[2] ..... F28B 1/06

[58] Field of Search ..... 165/DIG. 1, 129, 124, 165/110; 261/DIG. 11

[56] References Cited

UNITED STATES PATENTS 3,519,068 7/1970 Harris et al. ..... 165/122 X 3,844,344 10/1974 Kliemann et al. ..... 165/110

FOREIGN PATENTS OR APPLICATIONS 59,577 1/1968 Germany ..... 165/DIG. 1

*Primary Examiner*—Albert W. Davis, Jr.
*Attorney, Agent, or Firm*—Spencer & Kaye

[57] ABSTRACT

A cooling tower assembly comprising a natural draught tower having, arranged in the lower part thereof but spaced above the ground, a heat-exchanger assembly comprising a plurality of V or A frames each consisting of two mutually inclined banks of finned tubes with the apices of the frames lying in a set of parallel planes or two sets of parallel planes at right angles, the frames being of different lengths, and/or comprising banks of different lengths and arranged so as to fill the major part of the plan area of the lower part of the tower.

8 Claims, 6 Drawing Figures

FIG. 5.

HEAT EXCHANGER ASSEMBLIES

BACKGROUND OF THE INVENTION

1. Field of the invention

This invention relates to natural draught cooling tower assemblies in which the fluid to be cooled flows through finned tubes associated with a tower and air is assisted to flow over the tubes by chimney draught produced by the tower. The fluid to be cooled may change its state, i.e. be condensed, or may be cooled without change of state. Such assemblies find application in condensing steam and/or cooling condensate from steam turbines.

2. Description of the Prior Art

More specifically the invention is concerned with a natural draught cooling tower assembly of the kind, hereinafter referred to as of the kind specified, comprising a tower having a chimney part and apertured support means between the lower end of the chimney part and the ground, a heat-exchanger assembly within the lower part of the tower and spaced above the ground, the heat exchanger assembly comprising a plurality of finned tubes, the tubes being grouped together in banks, each bank comprising a plurality of parallel tubes arranged side by side, the banks being arranged in side by side pairs so that each pair forms a V-frame or A-frame with the banks diverging upwardly or downwardly from the apex of the V or A and with the tubes of each bank having their longitudinal axes running parallel to the apex of the frame, the frames covering a major part of the plan area of the lower part of the tower, and the support means and the heat exchanger assembly being arranged so that air can pass through the support means and through the heat exchanger assembly from beneath the assembly into the tower.

Heretofore in cooling tower assemblies of the kind specified the frames have been arranged so that, although the major part of said plan area has been occupied by the frames, there have been significant parts of the area not so occupied.

In one arrangement of the A-frames these have been arranged with their apices extending radially from the centre of the plan area which has been circular. Since the A-frames are rectangular in plan it will be appreciated that there will be unoccupied sector-shaped spaces between adjacent A-frames. These spaces have to be sealed to prevent air escaping past the tubes rather than flowing over them.

In another arrangement of A-frames which have all been of the same length, the apices of the frames have been arranged to lie in two sets of parallel planes, the planes of the two sets being mutually perpendicular. Since the A-frames are all the same size and are rectangular in plan this has meant that the heat exchanger assembly has had a plan area of cruciform shape and has been bounded by two sets of mutually perpendicular lines, each set consisting of four lines, so that there have been significant sector-shaped spaces left between the outer periphery of the plan area of a heat exchanger assembly, between the junctions of the arms of the cruciform shape and the periphery of the plan area of the lower part of the tower, these spaces not being occupied with heat exchanger surface.

It is an object of the present invention to provide a cooling tower assembly of the kind specified in which greater utilization is made than heretofore of the plan area of the lower part of the tower.

SUMMARY OF THE INVENTION

According to the invention we provide a cooling tower assembly of the kind specified wherein the plan area of the lower part of the tower is bounded by a curved outer periphery, wherein the apices of all the frames lie in a set of parallel planes, or in two sets of parallel planes in which the planes of one set are perpendicular to the planes of the other, and wherein the heat exchanger assembly includes frames of different lengths, and/or frames consisting of banks of different lengths, and are arranged within said plan area to fill a major part thereof and so that the outer periphery of the plan area of the heat exchanger assembly is bounded by two sets of parallel lines, the lines of one set being perpendicular to the lines of the other set, each set having at least six lines.

By using frames and/or banks of different lengths the shape of the plan area of the heat exchanger assembly can be made to conform more closely to the shape of the plan area of the lower portion of the tower than heretofore.

Thus if the plan area of the lower part of the tower is circular the periphery of the heat exchanger assembly may be caused to have a multi-stepped shape which approximates to a circular shape by using frames of different lengths and the part of the plan area not occupied by the frames can be reduced as compared with arrangements in which all the frames are of the same length.

Various arrangements of frames are possible. In one such arrangement the centre portion of the plan area of the heat exchanger assembly is occupied by frames of the same length while the frames around the centre portion of the heat exchanger assembly are of different lengths so as to accommodate the plan area of the heat exchanger assembly closely to the plan area of the lower part of the tower.

In practice it will be desirable to restrict the number of different lengths of frame to facilitate servicing and the manufacture and stocking of spare parts. Frames of three to five different lengths will normally be used. Obviously the more different lengths of frame which are used the nearer will the plan area of the heat exchanger approach the plan area of the lower part of the tower.

The frames may be arranged on one or more levels. If the frames are arranged on more than one level then it is preferred that the frames in the centre portion of the heat exchanger assembly are at a lower level than the frames around the central portion of the heat exchanger assembly. The essential point is that there should be a free air space under the heat exchanger assembly to allow air to pass under the assembly and to flow upwardly through the assembly.

In the foregoing, we have referred specifically to the use of frames of different lengths. However, the invention equally includes within its scope the use of banks of tubes of different lengths, thus a frame may consist of a longer bank of tubes and a shorter bank of tubes. Frames of different lengths may be used with frames comprising banks of different lengths so as to more exactly to fill the plan area of the lower part of the tower to be occupied by the heat exchanger assembly.

BRIEF DESCRIPTION OF THE DRAWINGS

The invention will now be described in detail by way of example with reference to the accompanying drawings, in which.

DESCRIPTION OF THE PREFERRED EMBODIMENTS

Referring first to FIGS. 1 to 5, a natural draught tower is indicated generally at 20 and includes a chimney part 21 and apertured support means 22 between the lower end 23 of the chimney part and the ground 24.

Arranged within the lower end of the tower are six heat exchanger assemblies. Each of the assemblies includes a plurality of V-frames. Each frame comprises a plurality of finned tubes which are grouped together into two banks. Each bank comprises a plurality of parallel tubes arranged side by side and two such banks are associated with one another to form a V-frame being inclined to one another so that they diverge from a lower apex of the frame, the tubes of each bank being arranged with their longitudinal axes parallel to the apex of the frame.

Figure 5:
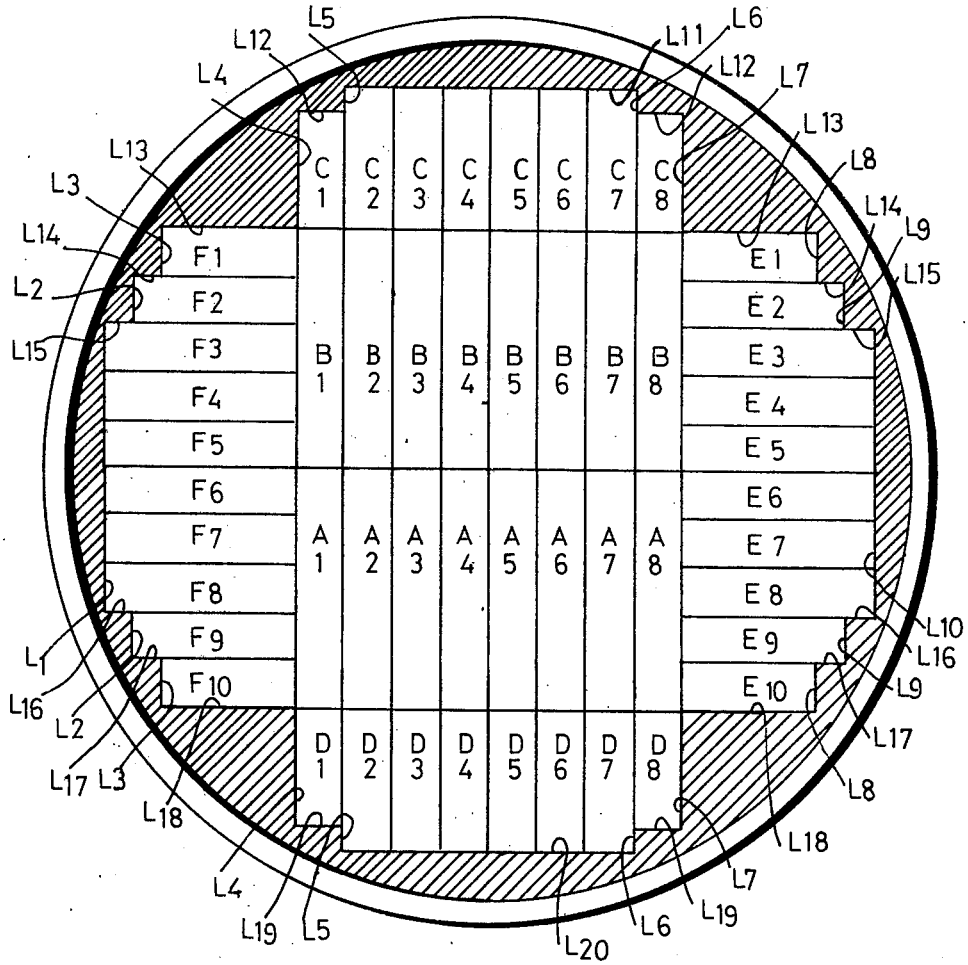
FIG. 5 is a diagrammatic plan view of the tower and heat exchanger assemblies showing one arrangement of the frames of the latter.

Referring to FIG. 5, there are arranged six heat exchanger assemblies within the lower portion of the tower 20. There are two central heat exchanger assemblies A and B each consisting of eight V-frame references A1–A8 and B1–B8 respectively. It will be noted that all the V-frames, each of which is represented by a full line rectangle, are of the same length.

Surrounding the heat exchanger assemblies A and B are four further heat exchanger assemblies C, D, E and F. The heat exchanger assemblies A and B are at a lower level above the ground line 24 than the heat exchanger assemblies C to F as is clearly shown in FIG. 4 for the V-frames B5 and C5.

Each of the heat exchanger assemblies C and D consists of eight V-frames C1–C8 and D1–D8. It will be seen that the V-frames C1 and C8 are shorter than the remaining V-frames in the heat exchanger assembly C and the V-frames D1 and D8 are shorter than the remaining V-frames in the heat exchanger assembly D.

The heat exchanger assemblies E and F each comprise ten V-frames. Taking for example the heat exchanger assembly E, the V-frames E3 to E8 inclusive are all of the same length, the V-frames E2 and E9 are shorter than the V-frames E3–E8 and the V-frames E1 and E10 are shorter than the V-frames E2 and E9. Similarly, the V-frames F2 and F9 are shorter than the V-frames F3–F8 and the V-frames F1 and F10 are shorter than the V-frames F2 and F9. It will be seen from FIG. 2 that the assembly of V-frames present a zig-zag shape in vertical section and from FIG. 5 that the apices of the shape lie in two sets of planes at right angles. Thus the apices of the V-frames in the heat exchanger assemblies A, B, C and D are parallel and are perpendicular to the apices of the V-frames in the heat exchanger assemblies E and F.

The plan area of the heat exchanger assemblies i.e. the total plan area of the assemblies A–F is bounded by two sets of parallel lines, the lines of one set being perpendicular to the lines of the other set. Thus on FIG. 5 the lines of one set are indicated at L1 to L10 and the lines of the other set at L11 to L20. If the frames were all of the same length the assemblies would have a plan area of cruciform shape bounded by two sets of lines, each set having four lines. By making the frames of different lengths, the number of lines in each set increases and the plan area of the assemblies fills a greater part of the plan area of the tower so that more heat exchange surface is available. The minimum number of lines in each set is six and this would correspond to the use of frames of only two different lengths along two opposite sides only of the plan area of the heat exchanger assemblies.

Figure 3:
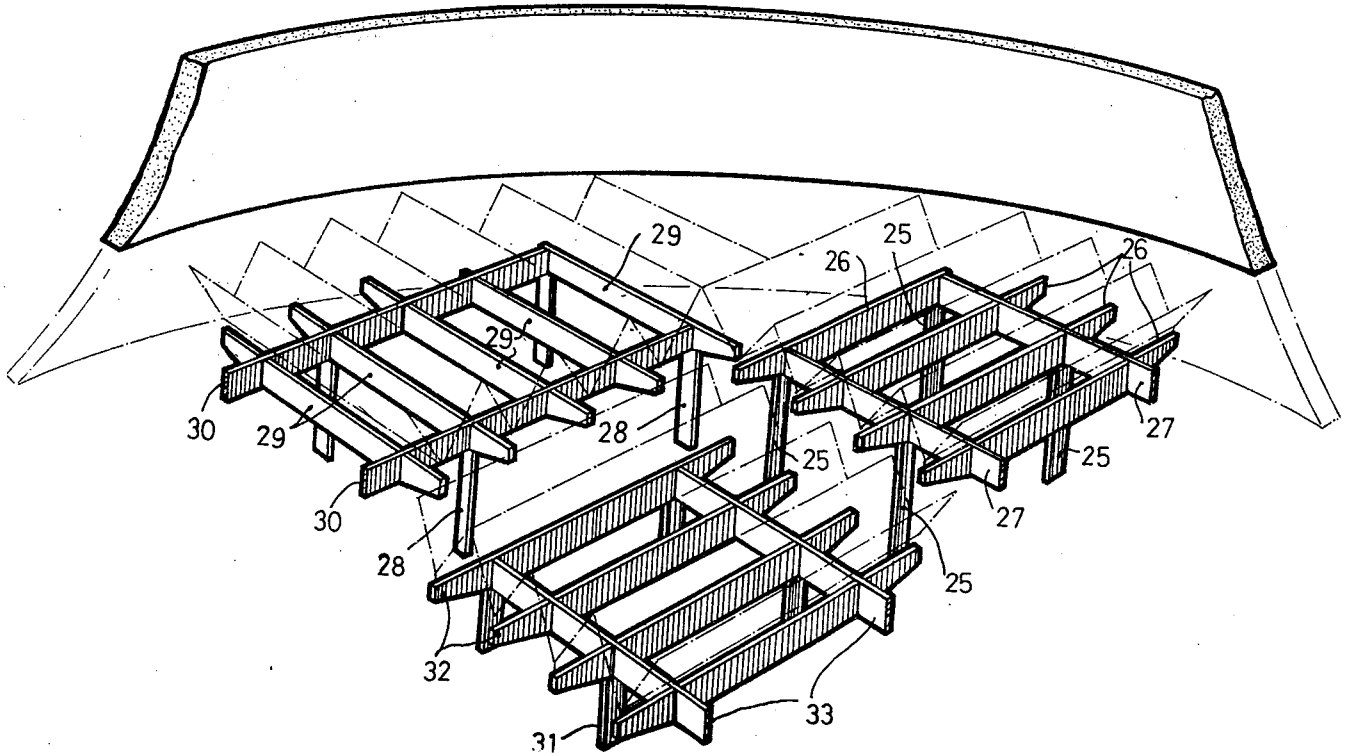
FIG. 3 is a perspective view showing the support structure of the V-frames shown in FIG. 2.

Referring to FIG. 3, this shows part of the support structure for the V-frames and shows part of the support structure for the heat exchanger assemblies B, C and F.

The support structure for the heat exchanger assembly C comprises a plurality of pillars 25 which support a grid work of horizontal beams having longitudinal support beams 26 and tie beams 27. Each longitudinal support beam 26 is arranged to support the lower apex of the V-frame as will be described below. Similarly, the support structure for the heat exchanger assembly F comprises pillars 28, longitudinal support beams 29 and tie beams 30. The support structure for the heat exchanger assembly B comprises pillars 31, longitudinal support beams 32 and tie beams 33. As will be seen from FIG. 4, the pillars 31 are shorter than the pillars 25 thus supporting the V-frames of the heat exchanger assembly B at a lower level than the V-frames of the heat exchanger assembly C.

Figure 1:
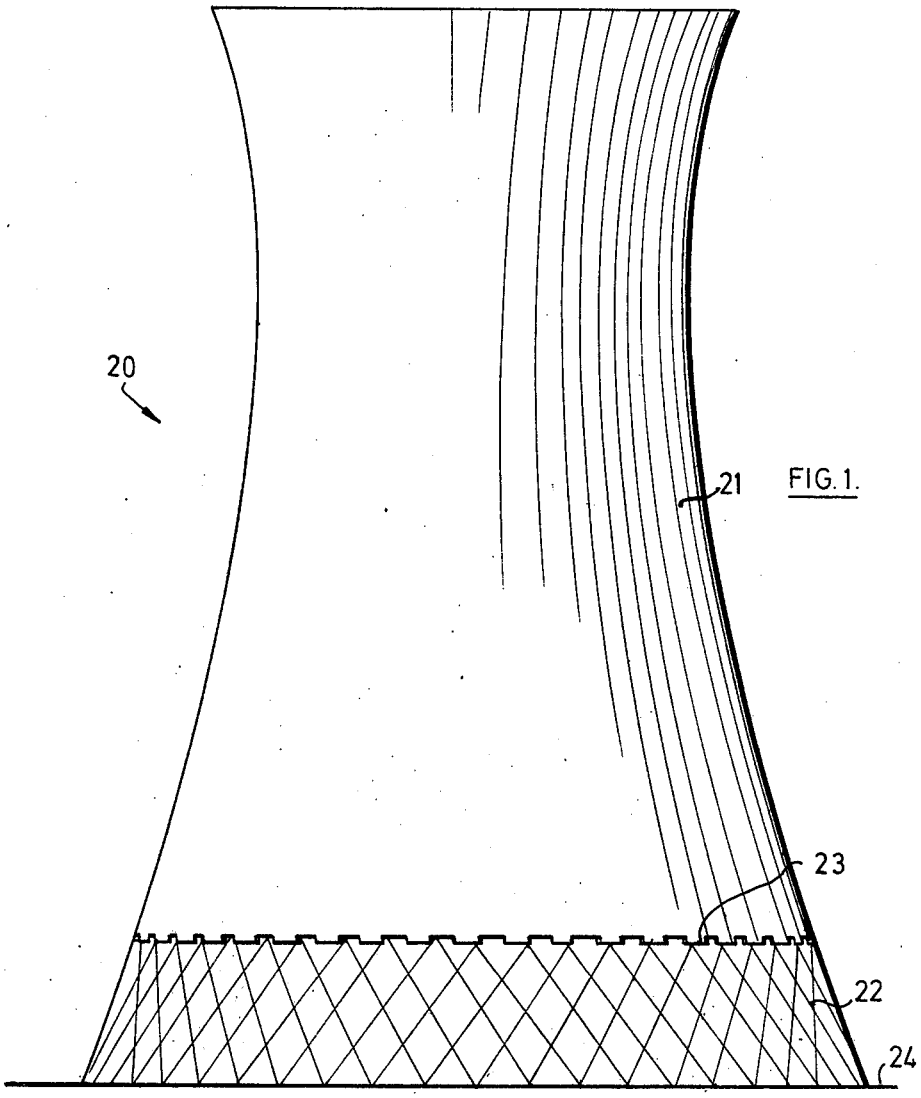
FIG. 1 is an elevation of a natural draught cooling tower containing a heat exchanger assembly.
Figure 2:
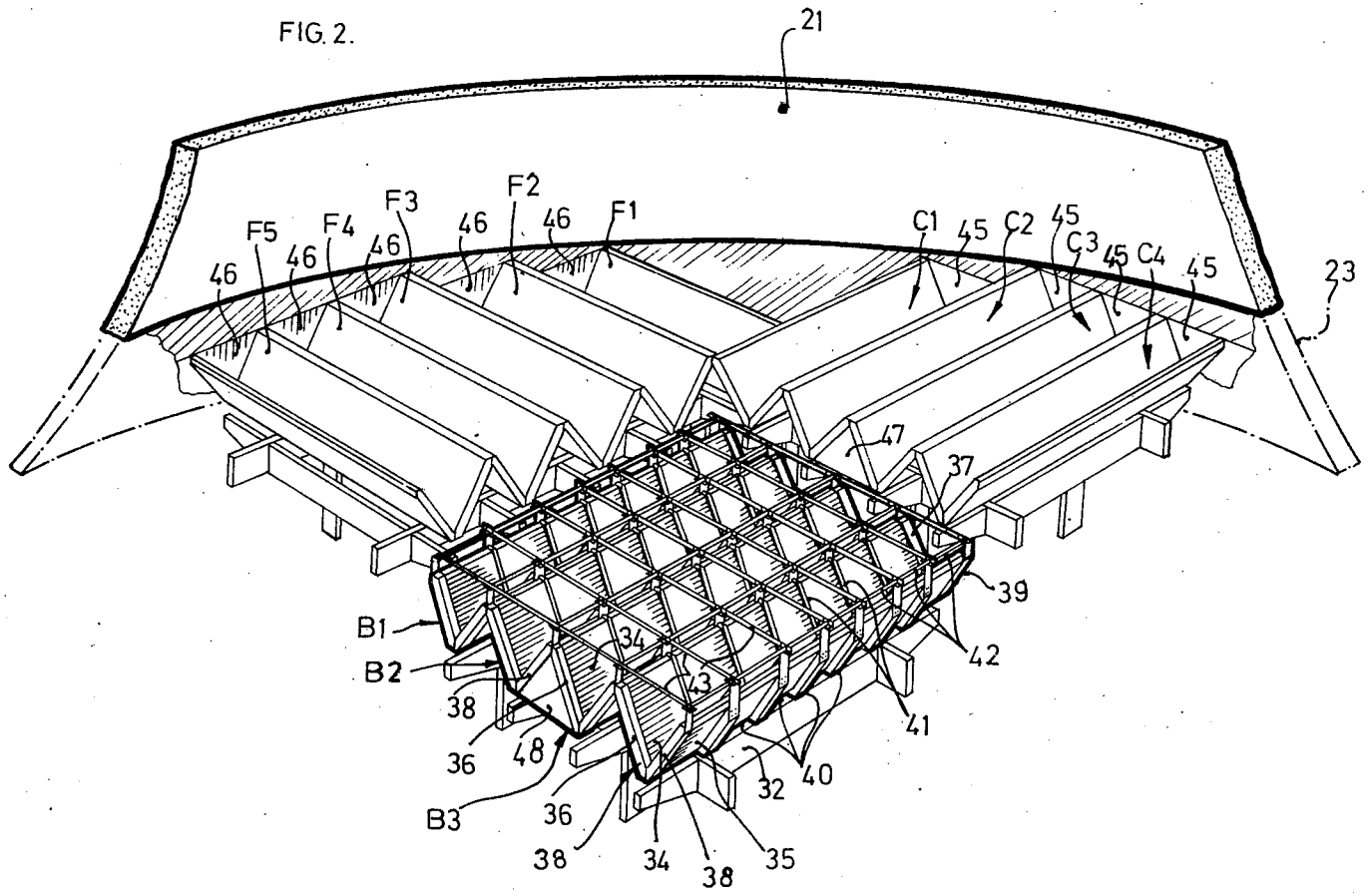
FIG. 2 is a perspective view, partly diagrammatic, of part of the arrangement of heat exchanger assemblies within the tower of FIG. 1.
Figure 4:
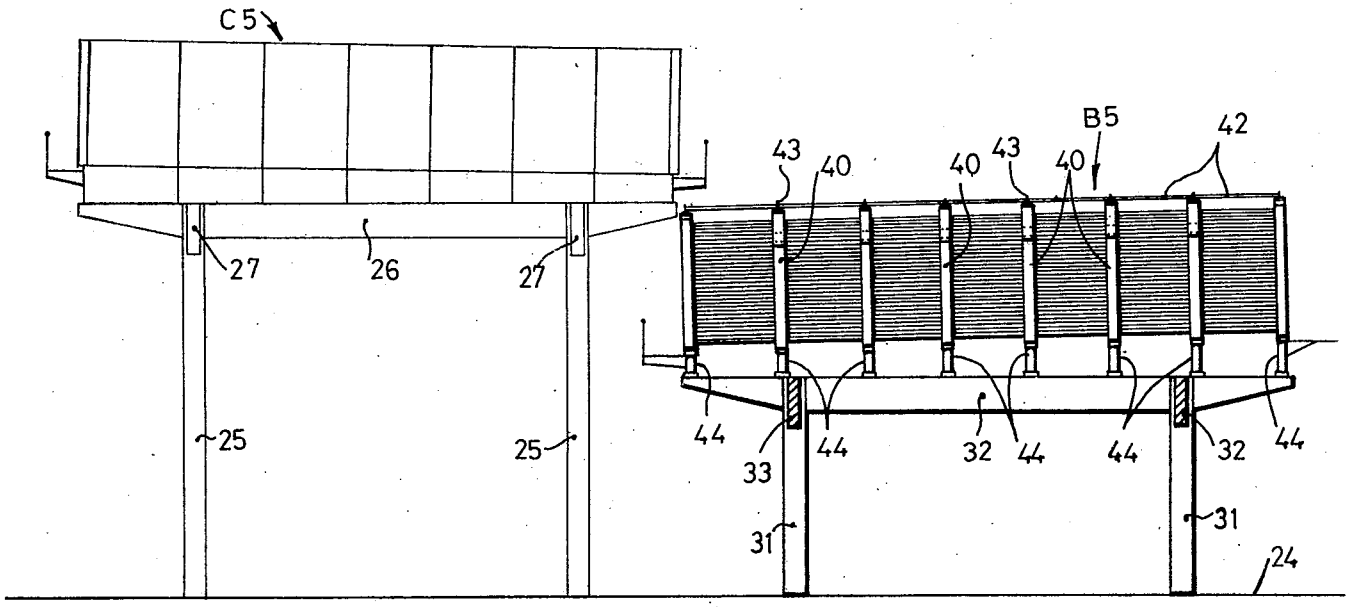
FIG. 4 is a section on the line 4—4 of FIG. 5 clearly showing the two levels of the inner and outer heat exchanger assemblies.

All the V-frames are of identical construction, apart from the length thereof, and the construction will be described generally in relation to the V-frames of the heat exchanger assembly B which are shown in FIGS. 2 and 4.

Each V-frame comprises two banks of finned tubes 34, 35, the tubes in each bank are parallel and extend parallel to the lower apex of the V-frame. The tubes of the bank 34 are connected at their ends to headers 36 and 37 and the tubes of the bank 35 are connected at their ends to headers 38 and 39. Between the headers, the tubes of each bank are supported by aligned pairs of transverse support members, some of the lower members being indicated at 40 and upper members at 41. The support members of each pair are connected together and are connected to the support members of the other bank of the frame. The interconnected support members are themselves connected longitudinally of the frame by tie bars 42 and the upper edges of the banks of the V-frame are connected by further tie bars 43.

As will be seen from FIG. 4, as exemplified by the V-frame, B5, the lower apex of each V-frame is supported from its associated longitudinal support beam by a plurality of upstanding columns 44 which raise the lower apex of the V-frame above the support beam 32. It will be seen from FIG. 4, also, that the upstanding columns 44 are not all of the same length so that the apex of the V-frame is slightly inclined to the horizontal at an angle, for example, of about 5°, to facilitate draining. It will be seen that the V-frame B5 slopes to the left in FIG. 4 whereas the V-frame C5, which is exemplary of the V-frames of the outer heat exchanger assemblies, slopes to the right i.e. towards the centre of the tower.

When the assembly is in operation, fluid to be cooled or condensed is passed into the headers of the various V-frames such as the headers 36 and 38 and is passed through the tubes with any convenient pass arrangement. Air enters the tower through the apertured support means 22 and flows under the heat exchanger assemblies and then is pulled through the heat exchanger assemblies by the chimney draught provided by the warmed air which is rising through the chimney part 21. It will be noted from FIG. 2 that the upper apices of the heat exchanger assemblies are substantially level with the lower end 23 of the chimney part 21 of the tower. By way of example, this lower end may be 50 feet above the ground level and the lower apices of the V-frames in the lower heat exchanger assemblies A and B may be at a height approximately 23 feet above the ground. Known means may be provided for causing the medium to be cooled or condensed to flow through the banks of tubes and the slope on the V-frames as shown in FIG. 4 assists in draining them.

Air enters the tower 20 through the apertured means 22 and flows under the V-frames which are spaced above the ground on their supporting structures as indicated in FIG. 4 and then flows upwardly through the V-frames. Sealing means must be provided to prevent the air from flowing up the tower without passing through the finned tubes. Thus the outer ends of all the V-frames in each heat exchanger assembly, i.e. the ends nearer the periphery of the tower, are provided with blanking plates some of which are shown in FIG. 2. Thus the blanking plates for the V-frames of the heat exchanger assembly C are indicated at 45 and those for the heat exchanger assembly F at 46. Although not shown, there will be similar blanking plates for the outer ends of the V-frames of the heat exchanger assembly B i.e. the ends adjacent the headers 37 and 39. There will also be blanking plates, not all of which are shown, between the inner ends of adjacent V-frames. Thus one such blanking plate between the V-frames C2 and C3 is shown at 47. The other similar plates are omitted to give a clear view of the supporting structure. Similarly the inner ends of the adjacent V-frames of the heat exchanger assemblies A and B will be blanked off and one such blanking plate is indicated at 48, the remaining blanking plates being omitted so as to show clearly the supporting structure. In addition, the whole of the plan area not covered by the V-frames will be filled with blanking plates as indicated by the shaded area in FIG. 5 and FIG. 2.

Figure 6:
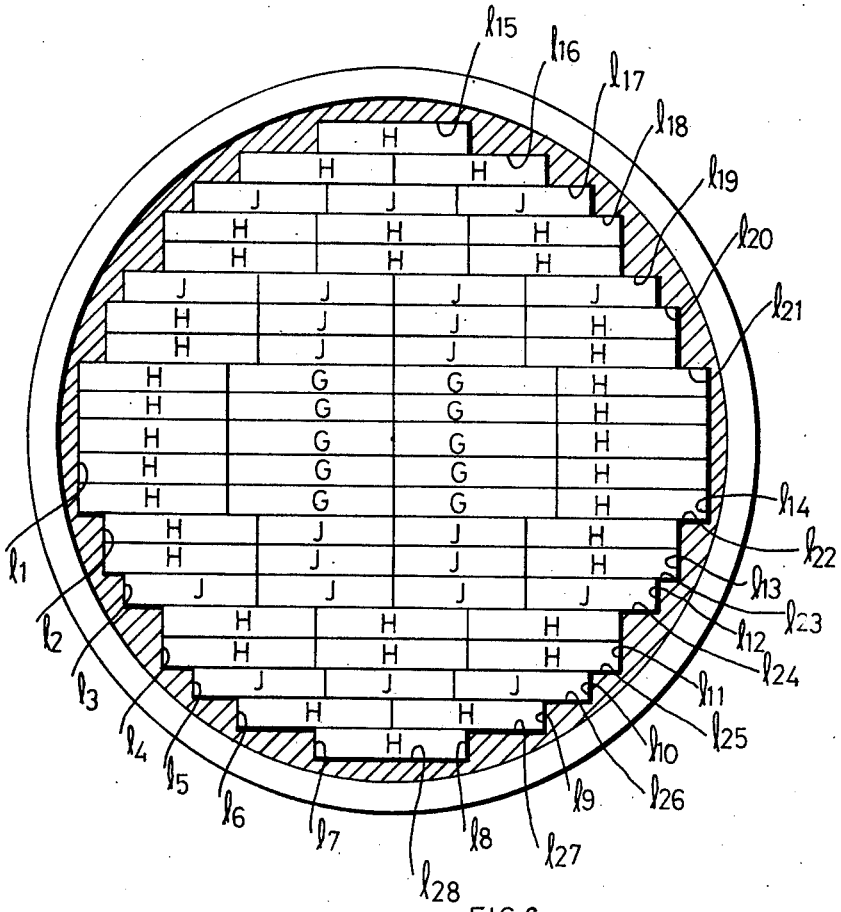
FIG. 6 is a diagrammatic plan view similar to FIG. 5 but showing another arrangement of the heat exchanger frames.

FIG. 6 shows a somewhat different arrangement of frames in which a greater part of the plan area of the tower is filled with frames than in the arrangement of FIG. 5. In FIG. 6 each rectangle represents a V-frame or A-frame. The arrangement of FIG. 6 uses frames of only three different lengths and these are all arranged at the same level within the tower. Frames of the same length are referred to by the same letter, the frames G being the longest, the frames J the shortest and the frames H of a length between those of G and J. Thus in the middle of the tower are arranged in a block five rows each consisting of two G frames and two H frames. This block is flanked on each side by two rows containing two H frames and two J frames these are flanked on each side by the following rows in succession, a row of four J frames, two rows of three H frames, a row of three J frames, a row of two H frames and finally, a single H frame.

The plan area of the heat exchanger assembly is bounded, in FIG. 6 by two sets of lines, each set containing fourteen lines. The lines of one set are indicated at *l* 1 to *l* 14 and those of the other set by *l* 15 to *l* 28. It will be seen that the greater number of lines in each set the greater proportion of the plan area of the tower is filled by the heat exchanger assemblies.

We have found that by using V-frames of different sizes it is possible to utilize a greater part of the plan area of the tower than if using V-frames which are all of the same size and we have found that an increase in usable heat exchange area of up to 20 percent can be obtained.

I claim:

1. A cooling tower assembly, comprising a tower having a chimney part and apertured support means between the lower end of the chimney part and the ground, and a heat-exchanger assembly within the lower part of the tower and spaced above the ground, the plan area of the lower part of the tower being bounded by a curved outer periphery, the heat exchanger assembly comprising a plurality of finned tubes, the tubes being grouped together in banks, each bank comprising a plurality of parallel tubes arranged side by side with their ends received in headers, the banks being arranged in side-by-side pairs so that each pair forms a V-frame or A-frame with the banks diverging upwardly or downwardly from the apex of the V or A and with the tubes of each bank having their longitudinal axes running parallel to the apex of the frame, wherein the apex of each frame lies in a plane of a set of parallel planes, and wherein the banks of which the heat exchanger assembly is essentially comprised are of different lengths but are otherwise substantially identical, such banks being arranged within said plan area to fill a major part thereof and so that the outer periphery of the plan area of the heat exchanger assembly is bounded by two sets of parallel lines, the lines of one set being perpendicular to the lines of the other set, each set having at least six lines, the support means and the heat exchanger assembly being arranged so that air can pass through the support means and through the heat exchanger assembly from beneath the assembly into the tower.

2. A cooling tower assembly according to claim 1 in which the centre portion of the plan area of the heat exchanger assembly is occupied by banks of the same length while the banks around the centre portion of the heat exchanger assembly are of different lengths.

3. A cooling tower assembly according to claim 1 in which the banks of the heat exchanger assembly have between three and five different lengths.

4. A cooling tower assembly according to claim 1 wherein the banks are arranged so that those in the central portion of the heat exchanger assembly are at a lower level than the banks around the central portion of the heat exchanger assembly.

5. A cooling tower assembly, comprising a tower having a chimney part and apertured support means between the lower end of the chimney part and the ground, and a heat-exchanger assembly within the lower part of the tower and spaced above the ground, the plan area of the lower part of the tower being bounded by a curved outer periphery, the heat-exchanger assembly comprising a plurality of finned tubes, the tubes being grouped together in banks, each bank comprising a plurality of parallel tubes arranged side by side with their ends received in headers, the banks being arranged in side-by-side pairs so that each pair forms a V-frame or A-frame with the banks diverging upwardly or downwardly from the apex of the V or A and with the tubes of each bank having their longitudinal axes running parallel to the apex of the frame, wherein the apex of each frame lies in a plane of two sets of parallel planes in which the planes of one set are perpendicular to the planes of the other set, and wherein the banks of which the heat-exchanger assembly is essentially comprised are of different lengths but are otherwise substantially identical, such banks being arranged within said plan area to fill a major part thereof and so that the outer periphery of the plan area of the heat-exchanger assembly is bounded by two sets of parallel lines, the lines of one set being perpendicular to the lines of the other set, each set having at least six lines, the support means and the heat-exchanger assembly being arranged so that air can pass through the support means and through the heat-exchanger assembly from beneath the assembly into the tower.

6. A cooling tower assembly according to claim 5 in which the centre portion of the plan area of the heat-exchanger assembly is occupied by banks of the same length while the banks around the centre portion of the heat-exchanger assembly are of different lengths.

7. A cooling tower assembly according to claim 5 in which the banks of the heat-exchanger assembly have between three and five different lengths.

8. A cooling tower assembly according to claim 5 wherein the banks are arranged so that those in the central portion of the heat-exchanger assembly are at a lower level than the banks around the central portion of the heat-exchanger assembly.

* * * * *